US009341428B2

(12) United States Patent
An

(10) Patent No.: US 9,341,428 B2
(45) Date of Patent: May 17, 2016

(54) AUTOMATIC CLEANING APPARATUS FOR GUN BARREL

(71) Applicant: SooSung Machinery Co., Ltd., Ulsan (KR)

(72) Inventor: Sang Jin An, Ulsan (KR)

(73) Assignee: SooSung Machinery Co., Ltd., Ulsan (KR)

( * ) Notice: Subject to any disclaimer, the term of this patent is extended or adjusted under 35 U.S.C. 154(b) by 0 days.

(21) Appl. No.: 14/467,829

(22) Filed: Aug. 25, 2014

(65) Prior Publication Data

US 2015/0059107 A1 Mar. 5, 2015

(30) Foreign Application Priority Data

Aug. 30, 2013 (KR) ..... 10-2013-0103882

(51) Int. Cl.
*F41A 29/02* (2006.01)
*F41A 29/00* (2006.01)

(52) U.S. Cl.
CPC ..... *F41A 29/02* (2013.01); *F41A 29/00* (2013.01)

(58) Field of Classification Search
CPC ..... F41A 29/00; F41A 29/02
USPC ..... 42/95
See application file for complete search history.

(56) References Cited

U.S. PATENT DOCUMENTS 3,901,098 A * 8/1975 Jinkins ..... 74/417
4,499,625 A * 2/1985 Bottomley ..... 15/104.165
5,052,496 A * 10/1991 Albert et al. ..... 173/29
8,434,256 B2 * 5/2013 An ..... 42/95
2006/0218735 A1 10/2006 Parker-Smith
2007/0240353 A1 10/2007 An
2008/0229644 A1 9/2008 An
2011/0179592 A1 7/2011 An

FOREIGN PATENT DOCUMENTS

KR 10-2000-0039709 A 7/2000
KR 10-0377487 B1 3/2003

(Continued)

OTHER PUBLICATIONS

International Search Report and Written Opinion dated May 27, 2014 7 pages.

(Continued)

*Primary Examiner* — Troy Chambers
*Assistant Examiner* — Joshua Semick
(74) *Attorney, Agent, or Firm* — Flaster/Greenberg P.C.

(57) ABSTRACT

Disclosed herein is an automatic cleaning apparatus for a gun barrel having cleaning means, wherein the cleaning means includes: a cylindrical tube having a plurality of insertion holes along the circumference thereof; a rotary gear connected to and driven by a motor; and cleaning members each of which includes a rotary shaft inserted into the insertion hole and a bevel gear joined to the lower portion of the rotary shaft and interlocking with the rotary gear, wherein the insertion hole includes a small hole and a large hole communicating laterally with the small hole, and wherein a fixing member fixes the cleaning member by making the cleaning member come into contact with the small hole when the cleaning member is fixed and does not prevent that the cleaning member is separated to the outside of the cylindrical tube through the large hole when the fixed cleaning member is released.

10 Claims, 4 Drawing Sheets

(56) References Cited

FOREIGN PATENT DOCUMENTS

| | | | |
|---|---|---|---|
| KR | 10-0610183 | B1 | 8/2006 |
| KR | 10-0662606 | B1 | 12/2006 |
| KR | 10-0822411 | B1 | 4/2008 |
| KR | 2009-013488 | A | 2/2009 |
| KR | 10-0920446 | B1 | 9/2009 |
| KR | 10-1046234 | B1 | 6/2011 |

OTHER PUBLICATIONS

European Search Report dated Jan. 14, 2015 8 pages.

* cited by examiner

AUTOMATIC CLEANING APPARATUS FOR GUN BARREL

CROSS-REFERENCE TO RELATED APPLICATIONS

This application is based on and claims priority from Korean Patent Application No. 10-2013-0103882 filed on Aug. 30, 2013 in the Korean Intellectual Property Office, the disclosure of which is incorporated herein in its entirety by reference.

BACKGROUND OF THE INVENTION

1. Field of the Invention

The present invention relates to an automatic cleaning apparatus for a gun barrel which can clean the inside of a gun barrel in which rifles are arranged.

2. Description of Related Art

After shells are fired, foreign matters generated after a charge of gunpowder or ammunition is burnt are stuck onto the inner face of a gun barrel, and hence, shells fired are deteriorated in accuracy. Therefore, a gun user removes particulates and foreign matters stuck on the inside of the gun barrel and rubs with inhibited oil after using the gun barrel.

In general, differently from small-sized guns which are personal portable firearms, firearms with a large-sized bore, such as self-propelled guns and towed artillery guns, are not disassembled for cleaning or anti-corrosion to be maintained or repaired.

Therefore, in order to clean the inside of the gun barrel, conventionally, the gun user connects a brush bar to an end portion of a connecting rod and carries out the repetitive pushing/pulling operations of the connecting rod into/from the gun barrel to remove particulates stuck to the inner circumferential surface of the gun barrel, but it is hard work requiring lots of manpower, time and physical strength.

Therefore, various technologies to automatically clean the inside of the gun barrel have been proposed, and Korean Patent Application No. 10-2010-0007407 filed by the inventor of the present invention and granted to the inventor is one of the technologies.

The technology disclosed in Korean Patent Application No. 10-2010-0007407 relates to an apparatus for cleaning the inside of a gun barrel which is operated by a motor and rotates or reciprocates a cleaner mounted outside the cleaning apparatus while entering the inside of the gun barrel so as to clean the inside of the gun barrel. The cleaning apparatus can clean the inner faces of rifles formed on the inner side of the gun barrel in order to provide a rotary force when shells are fired, clean the gun barrel even though a cleaning tool is worn out, and is easy to replace the cleaning tool with a new one.

However, people demand an improved cleaning apparatus for a gun barrel which is easier to replace the cleaning tool connected to a cleaning member, is improved in durability of the cleaning member, is more convenient to replace and repair the cleaning member, and makes the cleaning tool connected to the cleaning member by a relatively simple structure be correctly movable along the rifles without departing from the rifles of the gun barrel.

PRIOR ARTS

Prior Art 1: Korean Patent No. 10-0377487 with Application No. 10-2005-0039179.

Prior Art 2: Korean Patent No. 10-0822411 with Application No. 10-2006-0033030.

Prior Art 3: Korean Patent No. 10-1046234 with Application No. 10-2010-0007407.

BRIEF SUMMARY OF THE INVENTION

Accordingly, the present invention has been made to solve the above-mentioned problems occurring in the prior arts, and it is an object of the present invention to provide an automatic cleaning apparatus for a gun barrel which is easier to replace the cleaning tool connected to a cleaning member, is improved in durability of the cleaning member, is more convenient to replace and repair the cleaning member, and makes the cleaning tool connected to the cleaning member by a relatively simple structure be correctly movable along the rifles without departing from the rifles of the gun barrel so as to be suitable for cleaning the gun barrel which has rifles.

To accomplish the above object, according to the present invention, there is provided an automatic cleaning apparatus for a gun barrel which includes cleaning means joined to a cylindrical body moving back and forth to the outside and the inside of the gun barrel by transferring rollers connected to and driven by a motor so as to clean the inside of the gun barrel, wherein the cleaning means includes: a cylindrical tube having a plurality of insertion holes formed along the circumference thereof; a rotary gear connected to and driven by the motor; and cleaning members each of which includes a rotary shaft inserted into the insertion hole and a bevel gear joined to the lower portion of the rotary shaft and interlocking with the rotary gear to rotate the cleaning member, wherein the insertion hole includes a small hole having a cross sectional form which is a part of a circle corresponding to the cross section of the rotary shaft, and a large hole communicating laterally with the small hole and having a cross sectional form which is a part of a circle larger than the largest cross section of the lower part of the rotary shaft, and wherein a fixing member fixes the cleaning member by making the cleaning member come into contact with the small hole when the cleaning member is fixed and does not prevent that the cleaning member is separated to the outside of the cylindrical tube through the large hole when the fixed cleaning member is released.

The fixing member includes: a downwardly extending portion which has an inwardly dented longitudinal section of a circle having the diameter corresponding to the small hole and which extends in the longitudinal direction of the rotary shaft; and a laterally extending portion which extends from one side of the downwardly extending portion in the lateral direction and is fixed to the cylindrical tube.

The laterally extending portion includes a through hole, and a receiving hole is formed at the top of the insertion hole connected to the large hole in the lateral direction and receiving the laterally extending portion, and the receiving hole includes a joining hole corresponding to the through hole, so that the fixing member is fixed to the cylindrical tube by fastening means which connects and fixes the through hole and the joining hole with each other.

The cleaning member includes: a case having a bottom plate of which the bottom side is fixed to the upper side of the rotary shaft and of which the upper side is opened; a seating member mounted inside the case by a spring interposed between the case and the seating member, such that a cleaning tool is seated on the seating member; and a lid covering the seating member and joining with the case, the lid having a stopper formed on the inner face of the upper portion thereof which prevents upward separation of the seating member, wherein the lid has a protrusion formed on the inner circumferential surface thereof and the seating member has a receiving slot corresponding to the protrusion in order to prevent a relative rotation of the lid and the seating member, and a distance from the upper side of the bottom plate to the stopper is longer than the height of the seating member.

The seating member has a receiving slot and the cleaning tool has a protrusion corresponding to the receiving slot in order to prevent a relative rotation of the seating member and the cleaning tool.

The lid includes: a hard material part for receiving the seating member; and a soft material part formed integrally with the hard material part by double shot injection molding the hard material part together with a material softer than the material of the hard material part, and the stopper is formed on the soft material part.

The case includes one or more discharge holes for discharging foreign matters to the outside of the case.

The cleaning tool includes: brush or a non-woven fabric for cleaning the inside of the rifles; and a fixing portion which fixes the lower end of the brush or the non-woven fabric and which is inserted into the seating member, wherein the brush or the non-woven fabric has a middle portion which is higher than the rim portion in such a way as to correspond with the cross section form of the rifles.

The cylindrical body includes one or more guide rollers each of which corresponds with one of the cleaning members, and each of the guide rollers is mounted at a position such that a spiral connecting the cleaning member and the corresponding guide roller coincides with a spiral of the rifle inside the gun barrel, whereby the guide roller and the cleaning member move along the predetermined rifles when the automatic cleaning apparatus is operated with the guide roller being inserted into the rifles.

The guide roller has the width corresponding to the width of the rifles and is joined to the cylindrical body so as to be inactively rotated by contact with the inner face of the rifles.

The cylindrical body has one or more rag mounting recesses formed in the surface in the circumferential direction, and a rounded rag is detachably mounted in the rag mounting recess.

The automatic cleaning apparatus for a gun barrel according to an embodiment of the present invention is improved in replacement and repair of the cleaning member because the cleaning member is easily separated from cleaning means, is easy to replace the cleaning tool connected to the cleaning member, is improved in durability of the cleaning member, and makes the cleaning tool connected to the cleaning member be correctly movable along the rifles without departing from the rifles of the gun barrel.

BRIEF DESCRIPTION OF THE SEVERAL VIEWS OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE INVENTION

Reference will be now made in detail to the preferred embodiments of the present invention with reference to the attached drawings.

Figure 1:
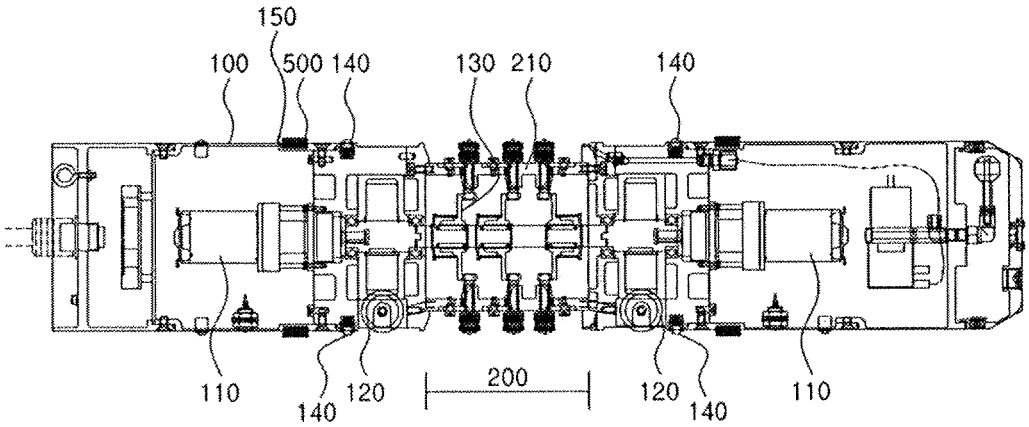
FIG. 1 is a sectional view showing an automatic cleaning apparatus for a gun barrel according to a preferred embodiment of the present invention.
Figure 2:
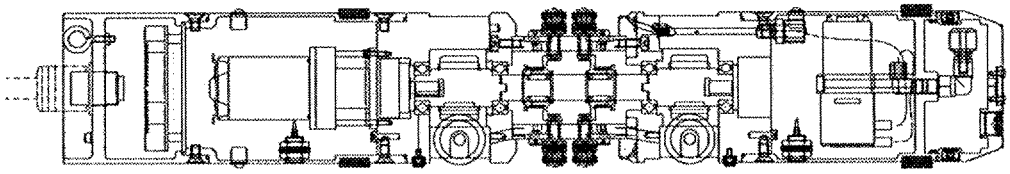
FIG. 2 is a sectional view showing an automatic cleaning apparatus for a gun barrel according to another preferred embodiment of the present invention.
Figure 3:
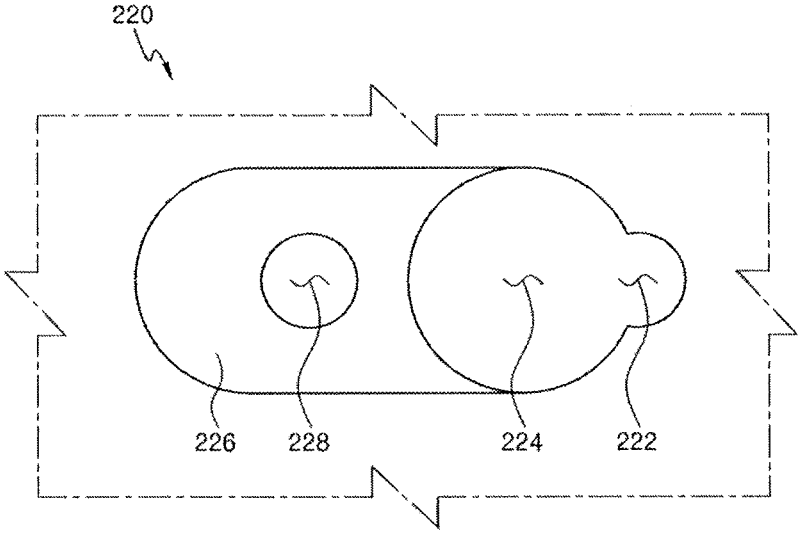
FIG. 3 is a plan view showing an insertion hole.

FIG. 1 is a sectional view showing an automatic cleaning apparatus for a gun barrel according to a preferred embodiment of the present invention, FIG. 2 is a sectional view showing an automatic cleaning apparatus for a gun barrel according to another preferred embodiment of the present invention, and FIG. 3 is a plan view showing an insertion hole.

The present invention relates to an automatic cleaning apparatus for a gun barrel which includes a cylindrical body 100 moving back and forth to the inside and the outside of a gun barrel, a motor, a transferring roller 120 interlocking with the motor 110, and cleaning means 200 connected to the cylindrical body 100 in order to clean the inside of the gun barrel in which a plurality of rifles are formed. FIG. 1 illustrates an automatic cleaning apparatus for a 155 mm gun barrel having 48 rifles, and FIG. 2 illustrates an automatic cleaning apparatus for a 105 mm gun barrel having 24 rifles.

The automatic cleaning apparatus illustrated in FIGS. 1 and 2 are different from each other in the number of the rifles, caliber, dimensions and shapes of components, but are the same from the viewpoint of the technical idea of the present invention, and hence, the present invention will be described only in relation to the preferred embodiment shown in FIG. 1.

Besides the motor 110 and the transferring roller 120, on the cylindrical body 100, a controller which controls the cylindrical body 100 and the cleaning means 200 is mounted and an oil tank which stores oil, such as treated oil and inhibited oil, to promote cleaning work and an oil pump for supplying oil are also mounted. The oil supplied through the oil pump is jet through a jet orifice abutting onto the cleaning means 200.

The cleaning means 200 includes a cylindrical tube 210 having a plurality of insertion holes 220 formed along the circumference thereof, a rotating gear 130 interlocking with the motor 110, and cleaning members 300.

Each of the cleaning members 300 includes a rotary shaft 310 inserted into the insertion hole 220, and a bevel gear 320 connected to the rotary shaft 310 and interlocking with the rotating gear 130 to rotate the cleaning member 300.

FIG. 3 is a plan view showing the insertion hole 220 according to the preferred embodiment of the present invention.

As shown in the drawing, each of the insertion holes 220 includes a small hole 222 and a large hole 224 which are formed to communicate with each other in the lateral direction, a receiving hole 226 connected to the large hole 224 in the lateral direction, and a joining hole 228 formed in the receiving hole 226.

The small hole 222 has a cross sectional form which is a part of a circle corresponding to the cross section of the rotary shaft 310, and the large hole 224 has a cross sectional form which is a part of a circle larger than the largest cross section of the lower part of the rotary shaft 310. In general, the largest cross section of the lower part of the rotary shaft 310 is the cross section of the uppermost side of the bevel gear 320 as shown in the drawing, but the present invention is not limited to the above.

The insertion holes 220 are formed to easily fix and separate the cleaning members 300 respectively inserted into the insertion holes 220, and technical characteristics to fix the cleaning members 300 into the insertion holes 220 will be described hereinafter.

Figure 4:
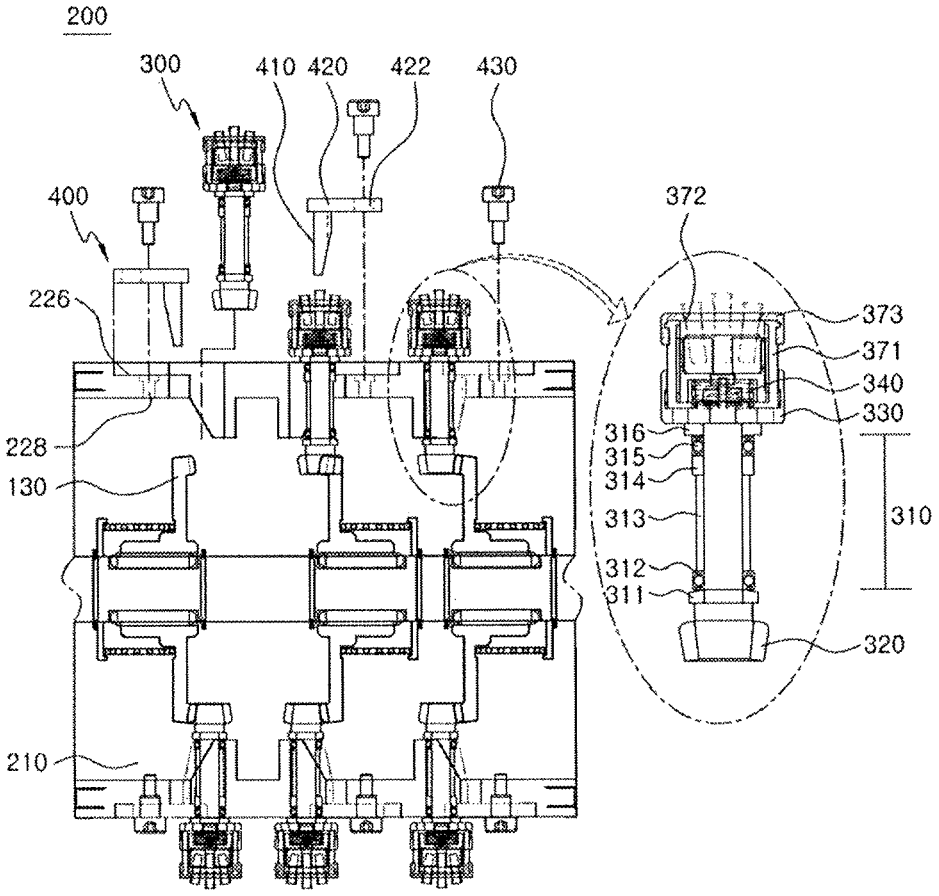
FIG. 4 is an enlarged sectional view of cleaning means of FIG. 1.

FIG. 4 is an enlarged sectional view of cleaning means of FIG. 1. In order to help understanding of the technical characteristics to insert and fix the cleaning members 300 into the insertion holes 220, FIG. 4 illustrates a change of three insertion holes which are located at the upper part, out of total six insertion holes 220, till the insertion and fixation of the cleaning members 300 are finished.

That is, FIG. 4 illustrates that the cleaning members 300 are completely fixed by fastening means 430 in a state where there is only the first upper insertion hole 220, in a state where the cleaning member 300 is inserted into the second upper insertion hole 220, in a state where the cleaning member 300 and a fixing member 400 are all inserted into the third upper insertion hole 220, and in a state where the cleaning members 300 and fixing members 400 are inserted into the lower insertion holes 220.

Figure 5:
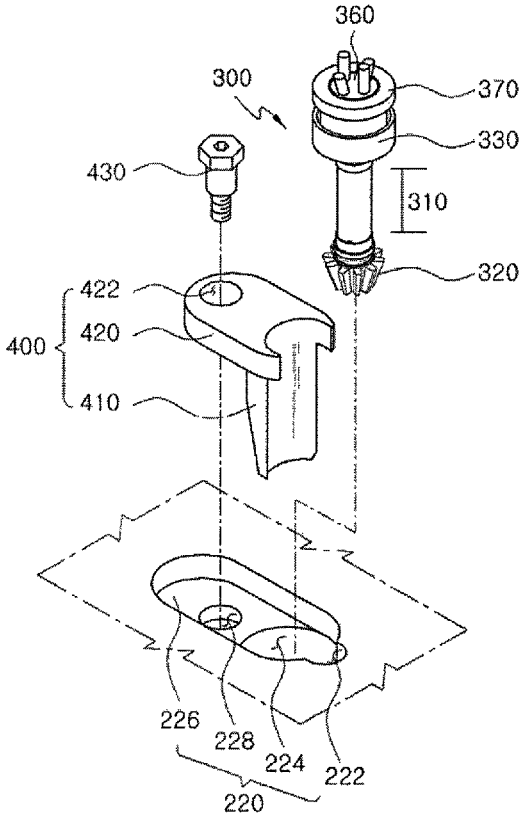
FIG. 5 is an exploded perspective view showing a connection relation between a cleaning member and a cylindrical tube.

Furthermore, FIG. 5 is an exploded perspective view showing a connection relation between the cleaning member 300 and the cylindrical tube 210.

As shown in FIGS. 4 and 5, the structure that the cleaning members 300 are inserted into the insertion holes 220 of the cylindrical tube 210 is as follows.

In order to fix the cleaning member 300, the fixing member 400 is used. The fixing member 400 is fixed in a state where the cleaning member 300 comes into contact with the small hole 222 when the cleaning member 300 is fixed, but the fixing member releases the cleaning member 300 so that the cleaning member 300 is separated from the small hole 222 so as not to prevent that the cleaning member 300 is separated out of the cylindrical tube 210 through the large hole 224.

In the preferred embodiment, the fixing member 400 includes: a downwardly extending portion 410 which has an inwardly dented longitudinal section of a circle having the diameter corresponding to the small hole 222 in order to make the rotary shaft 310 of the cleaning member 300 come into contact with the small hole 222 and which extends in the longitudinal direction of the rotary shaft 310; and a laterally extending portion 420 which extends from one side of the downwardly extending portion 410 in the lateral direction and is fixed to the cylindrical tube 210. The laterally extending portion 420 further includes a through hole 422.

The receiving hole 226 formed at the top of the insertion hole 220 receives the laterally extending portion 420, and the inwardly dented side of the downwardly extending portion 410 comes into contact with the small hole 222 while abutting on the rotary shaft 310 of the cleaning member 300 at the position where the joining hole 228 formed in the receiving hole 226 coincides with the through hole 422. In the above state, the fixing member 400 is fixed to the cylindrical tube 210 by the fastening means 430, such as bolts, rivets and pins, for connecting and fixing the through hole 422 and the joining hole 228 with each other. In the above state, the receiving hole 226 has a predetermined space formed at the rear of the fixing member 400, and due to the space, the downwardly extending portion 410 of the fixing member 400 and the cleaning member 300 can be moved from the small hole 222 to the large hole 224 when the fastening means 430 is removed, and after that, the cleaning member 300 can be separated out of the cylindrical tube 210 through the large hole 224.

In this instance, according to the width and length of the downwardly extending portion 410 and the size and form of the large hole 224, the cleaning member 300 and the fixing member 400 are separated from the large hole 224 in the state where the cleaning member 300 and the fixing member 400 come into contact with each other, or the cleaning member is separated from the large hole 224 after the fixing member 400 is first separated from the large hole 224.

Therefore, the cleaning member 300 can be easily attached to and detached from the cleaning means 200, the cleaning member 200 can be conveniently inspected, repaired and replaced. Additionally, when the cleaning tool attached to the top of the cleaning member 300 is worn out, it may be replaced in a state where the cleaning member 300 is fixed to the cylindrical tube 210 or replaced after the cleaning member 300 is separated from the cylindrical tube 210 as occasion demands.

Figure 6:
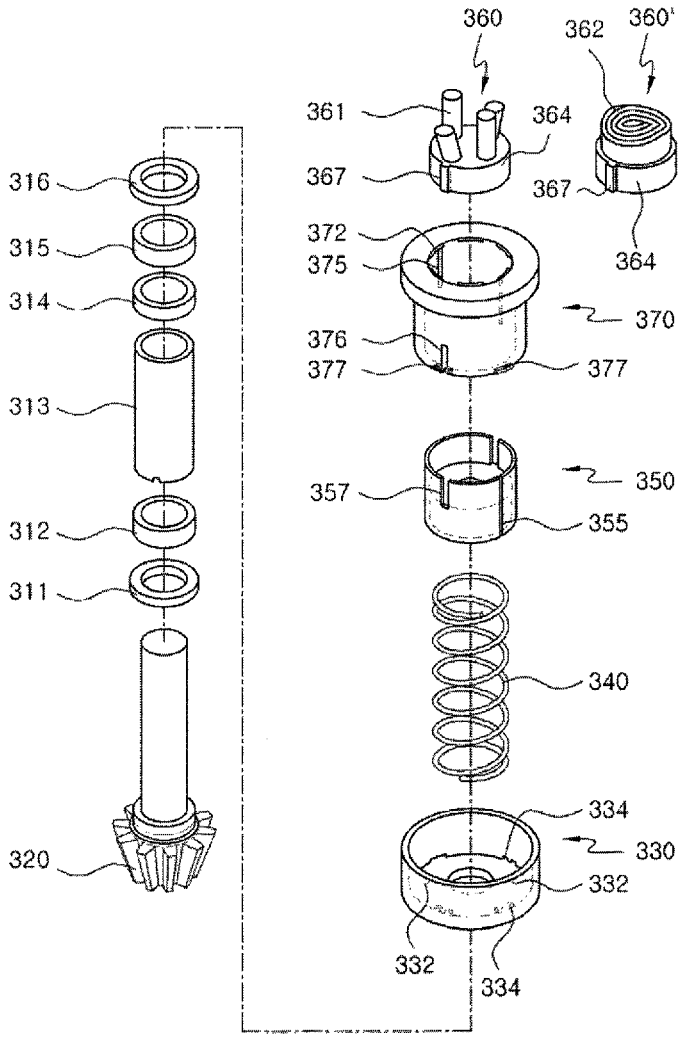
FIG. 6 is an exploded perspective e view of the cleaning member.

Referring to FIG. 6, an improvement of the cleaning member 300 will be described.

As described above, the cleaning member 300 includes the rotary shaft 310 and the bevel gear 320. The cleaning member 300 further includes a case 330 mounted at the upper side of the rotary shaft 310. The case 330 has a bottom plate of which the bottom side is fixed to the upper side of the rotary shaft 310 and of which the upper side is opened.

A seating member 350 is mounted above the case 330 and a spring 340 is interposed between the case 330 and the seating member 350. Cleaning tools 360 and 360' are detachably mounted above the seating member 350. A lid 370 is mounted on the seating member 350 to fix the seating member 350 not to be separated from the case 330. One or more stoppers 372 are formed on the inner face of the upper portion of the lid 370 to stop at least some of the upper rim of the seating member 350 so as to present that the seating member 350 which receives elasticity of the spring 340 is separated outwardly from the lid 370 of the case 330.

The lid 370 has a protrusion 375 formed on the inner circumferential surface thereof and the seating member 350 has a receiving slot 355 corresponding to the protrusion 375 in order to prevent a relative rotation of the lid 370 and the seating member 350. Moreover, in order to make the seating member 350 elastically supported by the spring 340 be displaced up and down to a predetermined distance, a distance from the upper side of the bottom plate to the stopper 372 is longer than the height of the seating member 350.

The lid 370 includes: a hard material part 371 which is accommodated inside the seating member 350 and of which the lower part is inserted and fixed into the case 330; and a soft material part 373 which is made of a material softer than the material of the hard material part 371 and which covers the upper side of the hard material part 371, and the stopper 372 is formed on the soft material part 373. It is preferable that the hard material part 371 be made of hard materials including an engineering plastic material and that the soft material part 373 be made of the soft material such as rubber and formed integrally by double shot injection molding with the hard material part 371.

Furthermore, it is preferable that the stopper 372 be slightly inclined in the downward direction to effectively prevent separation of the seating member 350 and to allow entrance of the cleaning tools 360 and 360' inserted into the seating member 350. Because the stopper 372 is formed on the soft material part 373, the cleaning tools 360 and 360' can be inserted more conveniently.

Because the rifles are cleaned by rotation of the cleaning tools 360 and 360' which move along the rifles, it must be guaranteed that the cleaning tools 360 and 360' are rotated smoothly without being rotated idly in response to the rotation of the bevel gear 320. The hard material part 371 is made of the hard material, such that the seating member 350 is rotated without idle rotation relative to the lid 370 in a state where the receiving slot 355 engages with the protrusion 375 because the seating member 350 is mainly made of a metal material.

Likewise, it is also important to prevent a relative rotation of the cleaning tools 360 and 360' relative to the seating member 350. So, it is preferable that the seating member 350 have a receiving slot 357 formed in the inner circumference thereof and the cleaning tools 360 and 360' have protrusions 367 formed on the outer circumferences thereof in order to prevent the relative rotation of the cleaning tools 360 and 360' and the seating member 350.

In the meantime, in order to an idle rotation of the lid 370 relative to the case 330, it is preferable that the lid have a protrusion 377 formed on the outer circumference thereof and the case 330 have a receiving slot 334 formed in the inner circumference thereof. In addition, in order to make the insertion and connection of the lid 370 into the case 330 easy, it is preferable that an elastic cut slot 376 is formed in the lower portion of the lid 370 to make an elastic deformation of the lower portion of the lid 370 easy.

According to the above structure, the rotation of the rotary shaft 310 is transferred to the case 330, the rotation of the case 330 is transferred to the lid 370, the rotation of the lid 370 is transferred to the seating member 350, and the rotation of the seating member 350 is transferred to the cleaning tools 360 and 360' without any idle rotation, so that the rifles are cleaned smoothly.

Because the inside of the case 370 may be contaminated due to accumulation of foreign matters introduced from the outside, it is preferable that the case 370 have one or more discharge holes 332 for discharging the foreign matters out. When the case 370 is rotated, the foreign matters are smoothly discharged out through the discharge holes 332 by the centrifugal force.

Each of the cleaning tools 360 and 360' includes: a brush 361 or a non-woven fabric 362; and a fixing portion 364 which fixes the lower end of the brush 361 or the non-woven fabric 362 and which is inserted into the seating member, and the protrusions 367 are respectively formed on the fixing portions 364 to prevent the relative rotation of the cleaning tools 360 and 360' relative to the seating member 350. It is preferable that the brush 361 or the non-woven fabric 362 has a middle portion which is higher than the rim portion in such a way as to correspond with the cross section form of the rifles.

According to kinds of work or order of work, the cleaning tool 360 or 360' made with the brush 361 or the non-woven fabric 362 is selected.

Meanwhile, the rotary shaft 310 includes rotary bearings 312 and 315 located up and down; spacers 313 and 314 for setting an interval between the rotary bearings 312 and 315; and an upper washer 316 and a lower washer 311 which are respectively mounted above the upper rotary bearing 315 and below the lower rotary bearing 312. Therefore, the lower side of the upper washer 316 and the upper side of the lower washer 311 come into contact with the upper end side and the lower end side of the small hole 222 in one direction and come into contact with the upper end and the lower end of the downwardly extending portion 410 to prevent a vertical separation of the cleaning member 300, and the cleaning member 300 is restrictedly rotated in a space formed between the small hole 222 and the downwardly extending portion 410.

In the meantime, as shown in FIG. 1, it is preferable that one or more guide rollers 140 corresponding with one of the cleaning members 300 be mounted on the cylindrical body 100. Here, the correspondence of the cleaning member 300 and the guide roller 140 means that the guide roller 140 is mounted relative to the cleaning member 300 so that the cleaning member 300 and the guide roller 140 are located inside at least one rifle of the gun barrel at the same time.

As described above, when the guide roller 140 is mounted, the guide roller 140 and the cleaning member 300 come into contact with the rifles and guide mutually while receiving a power, and move along the predetermined rifles without departing from the rifles. The guide roller 140 may be provided in correspondence with each of the cleaning members 300, may be provided in correspondence with several cleaning members 300, or just one guide roller 140 may be provided per all of the cleaning member 300. However, it is more preferable that a number of the guide rollers 140 are provided.

The guide roller 140 may be rotated actively, but may have the width corresponding to the width of the rifles and be joined to the cylindrical body 100 so as to be inactively rotated by contact with the inner face of the rifles.

Moreover, as shown in FIG. 1, it is preferable that one or more rag mounting recesses 150 formed in the surface of the cylindrical body 100 in the circumferential direction. Therefore, when a rounded rag 500 is detachably mounted in the rag mounting recess 150, it can be utilized to finish cleaning of the inside of the gun barrel after cleaning the rifles.

Next, the operation of the automatic cleaning apparatus for the gun barrel according to the preferred embodiments of the present invention will be described.

First, the user inserts the automatic cleaning apparatus into the gun barrel, and then, operates the motor 110 to make the automatic cleaning apparatus advance into the gun barrel. In this instance, because the guide roller 140 and the cleaning members 300 are mounted along the rifles, the automatic cleaning apparatus can follow the rifles without departing from the rifles inside the gun barrel by interaction among the transferring roller 120, the guide roller 140 and the cleaning member 300.

The cleaning means 200 are individually formed according to the number of the rifles inside the gun barrel in order to clean the rifles.

Therefore, the cleaning members 300 are rotated at high speed by the rotation of the bevel gear 320 interlocking with the rotary gear 130, and the cleaning tools 360 and 360' are rotated so as to clean the gun barrel using the brush 361 or the non-woven fabric 362. Here, when the brush 361 or the non-woven fabric 362 is worn out, the cleaning members 360 and 360' are returned in the upward direction as much as the compressed spring 340 is worn out, so that the cleaning apparatus can always clean the gun barrel under the same conditions and states. In this embodiment, because a difference between the minimum height and the maximum height of the seating member 350 is 2.7 mm, after new cleaning tools 360 and 360' are mounted, the cleaning tools 360 and 360' are not replaced till they are worn out to 2.7 mm.

Furthermore, if it is necessary to replace the cleaning tools 360 and 360', they can be separated when the user simply grasps and pulls the upper portion of the cleaning tools 360 and 360' using a tool such as a long nose plier. In this instance, the seating member 350 is not separated out of the lid 370 by the stopper 372. New cleaning tools 360 and 360' can be inserted when the user simply grasps and pushes the cleaning tools 360 and 360' using a simple tool. Because the stopper 372 strongly stops the upper rim of the seating tool 350 but slightly protrudes from the inner face of the rim and is inclined downwardly, the seating member 350 is prevented from separation and the cleaning tools 360 and 360' can be separated by a small power and inserted by a smaller power.

In case that the cleaning tools 360 and 360' are not replaced by the general method or inspection, replacement or repair of the cleaning members 300 is needed, the user releases the fastening means 430 fixing the fixing member 400 and simply pulls the fixing member 400 backwardly so as to separate the cleaning member 300. The user can reassemble the cleaning tools 360 and 360' by carrying out the above steps in reverse order, and hence, reassembly of the cleaning tools can be achieved very simply.

Although the present invention has been described in detail reference to its presently preferred embodiments, it will be understood by those skilled in the art that various modifications and equivalents can be made without departing from the spirit and scope of the present invention, as set forth in the appended claims.

I claim:

1. An automatic cleaning apparatus for a gun barrel comprising:

cleaning means joined to a cylindrical body moving back and forth to the outside and the inside of the gun barrel by transferring rollers connected to and driven by a motor so as to clean the inside of the gun barrel, wherein the cleaning means comprises:

a cylindrical tube having a plurality of insertion holes formed along the circumference thereof;

a rotary gear connected to and driven by the motor;

cleaning members each of which includes a rotary shaft inserted into the insertion hole and a bevel gear joined to the lower portion of the rotary shaft and interlocking with the rotary gear to rotate the cleaning member, wherein the insertion hole includes a small hole having a cross sectional form which is a part of a circle corresponding to the cross section of the rotary shaft, and a large hole communicating laterally with the small hole to form a closed curve together and having a cross sectional form which is a part of a circle larger than the largest cross section of the lower part of the rotary shaft; and fixing members each of which includes a downwardly extending portion which has an inwardly dented longitudinal section of a circle having the diameter corresponding to the small hole and which extends in the longitudinal direction of the rotary shaft, and a laterally extending portion which extends from one side of the downwardly extending portion in the lateral direction and is fixed to the cylindrical tube, wherein each fixing member and each insertion hole are adapted in such a way that the downwardly extending portion can be moved laterally inside the large hole when both the downwardly extending portion and the rotary shaft are inserted into the insertion hole, whereby the fixing member fixes the cleaning member by making the cleaning member come into contact with the small hole when the cleaning member is fixed and does not prevent that the cleaning member is separated to the outside of the cylindrical tube through the large hole when the fixed cleaning member is released.

2. The automatic cleaning apparatus according to claim 1, wherein the laterally extending portion comprises a through hole, and a receiving hole is formed at the top of the insertion hole connected to the large hole in the lateral direction and receiving the laterally extending portion, and the receiving hole comprises a joining hole corresponding to the through hole, so that the fixing member is fixed to the cylindrical tube by fastening means which connects and fixes the through hole and the joining hole with each other.

3. The automatic cleaning apparatus according to claim 1, wherein the cleaning member comprises:

a case having a bottom plate of which the bottom side is fixed to the upper side of the rotary shaft and of which the upper side is opened;

a seating member mounted inside the case by a spring interposed between the case and the seating member, such that a cleaning tool is seated on the seating member; and a lid covering the seating member and joining with the case, the lid having a stopper formed on the inner face of the upper portion thereof which prevents upward separation of the seating member, wherein the lid has a protrusion formed on the inner circumferential surface thereof and the seating member has a receiving slot corresponding to the protrusion in order to prevent a relative rotation of the lid and the seating member, and a distance from the upper side of the bottom plate to the stopper is longer than the height of the seating member.

4. The automatic cleaning apparatus according to claim 3, wherein the seating member has a receiving slot and the cleaning tool has a protrusion corresponding to the receiving slot in order to prevent a relative rotation of the seating member and the cleaning tool.

5. The automatic cleaning apparatus according to claim 3, wherein the lid comprises:

a hard material part for receiving the seating member; and a soft material part formed integrally with the hard material part by doubleshot injection molding the hard material part together with a material softer than the material of the hard material part, and the stopper is formed on the soft material part.

6. The automatic cleaning apparatus according to claim 3, wherein the case comprises one or more discharge holes for discharging foreign matters to the outside of the case.

7. The automatic cleaning apparatus according to claim 3, wherein the cleaning tool comprises:

brush or a non-woven fabric for cleaning the inside of the rifles; and a fixing portion which fixes the lower end of the brush or the non-woven fabric and which is inserted into the seating member, wherein the brush or the non-woven fabric has a middle portion which is higher than a rim portion in such a way as to correspond with the cross section form of the rifles.

8. The automatic cleaning apparatus according to claim 1, wherein the cylindrical body comprises one or more guide rollers each of which corresponds with one of the cleaning members, and each of the guide rollers is mounted at a position such that a spiral connecting the cleaning member and the corresponding guide roller coincides with a spiral of the rifle inside the gun barrel, whereby the guide roller and the cleaning member move along the predetermined rifles when the automatic cleaning apparatus is operated with the guide roller being inserted into the rifles.

9. The automatic cleaning apparatus according to claim 8, wherein the guide roller has the width corresponding to the width of the rifles and is joined to the cylindrical body so as to be inactively rotated by contact with the inner face of the rifles.

10. The automatic cleaning apparatus according to claim 1, wherein the cylindrical body has one or more rag mounting recesses formed in the surface in the circumferential direction, and a rounded rag is detachably mounted in the rag mounting recess.

* * * * *